US012709500B2

(12) United States Patent
Wind et al.

(10) Patent No.: US 12,709,500 B2
(45) Date of Patent: Aug. 18, 2026

(54) SHEET STACK HANDLER COMPRISING A SHEET STACKER AND/OR SHEET FEEDER FOR A PRINTER

(71) Applicant: CANON KABUSHIKI KAISHA, Tokyo (JP)

(72) Inventors: Anne A. Wind, Eindhoven (NL); Luke Habets, Elsloo (NL); Joris M. B. Weemaes, Eindhoven (NL)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/513,259

(22) Filed: Nov. 17, 2023

(65) Prior Publication Data

US 2024/0208749 A1 Jun. 27, 2024

(30) Foreign Application Priority Data

Dec. 21, 2022 (EP) ..... 22215463

(51) Int. Cl.
*B65H 1/26* (2006.01)
*B65H 1/04* (2006.01)
(Continued)

(52) U.S. Cl.
CPC ..... *B65H 1/263* (2013.01); *B65H 1/04* (2013.01); *B65H 1/14* (2013.01); *B65H 1/26* (2013.01);
(Continued)

(58) Field of Classification Search
CPC ... B65H 1/04; B65H 1/14; B65H 1/18; B65H 1/26; B65H 1/263; B65H 1/266; B65H 1/28; B65H 7/04; B65H 31/22; B65H 31/24; B65H 31/3063; B65H 31/32; B65H 2301/42256; B65H 2402/32; B65H 2405/15; B65H 2405/31;
(Continued)

(56) References Cited

U.S. PATENT DOCUMENTS 5,011,126 A * 4/1991 Suzuki ..... B65H 1/263 414/796
5,240,369 A 8/1993 Voss
2022/0089389 A1* 3/2022 Rod ..... B65H 1/263

FOREIGN PATENT DOCUMENTS

EP 3594155 A1 1/2020
JP 2000226126 A 8/2000
(Continued)

*Primary Examiner* — Prasad V Gokhale
(74) *Attorney, Agent, or Firm* — Canon U.S.A., Inc. IP Division

(57) ABSTRACT

A sheet stack handler includes first and second liftable stack supports, a sheet engager for stacking a sheet onto a stack of sheets, a lift assembly, and a translation mechanism. The lift assembly moves the first or second liftable stack supports between a bottom and top position. A stack holding volume is defined between the bottom and top positions. The lift assembly positions a top sheet of the stack of sheets and/or on the first or second liftable stack supports inside the stack holding volume at an operative level to allow the sheet engager to stack a new sheet and/or separate the top sheet from the respective stack of sheets. The translation mechanism translates one of the first and second liftable stack supports while supporting a sheet stack between a buffer position outside of the stack holding volume and an active position inside the stack holding volume.

10 Claims, 7 Drawing Sheets

(51) Int. Cl.

| | |
|---|---|
| ***B65H 1/14*** | (2006.01) |
| ***B65H 1/28*** | (2006.01) |
| ***B65H 31/22*** | (2006.01) |
| ***B65H 31/24*** | (2006.01) |
| ***B65H 31/30*** | (2006.01) |
| ***B65H 31/32*** | (2006.01) |

(52) U.S. Cl.
CPC ..... *B65H 1/266* (2013.01); *B65H 1/28* (2013.01); *B65H 31/22* (2013.01); *B65H 31/24* (2013.01); *B65H 31/3063* (2013.01); *B65H 31/32* (2013.01); *B65H 2301/42256* (2013.01); *B65H 2405/15* (2013.01); *B65H 2405/3311* (2013.01)

(58) Field of Classification Search
CPC ..... B65H 2405/3311; B65H 2405/35; B65H 2405/351; B65H 2405/3521; B65H 2511/15
See application file for complete search history.

(56) References Cited

FOREIGN PATENT DOCUMENTS

| | | |
|---|---|---|
| JP | 2018002366 A | 1/2018 |
| JP | 2023506521 | 2/2023 |
| WO | 2021122109 A1 | 6/2021 |

* cited by examiner

SHEET STACK HANDLER COMPRISING A SHEET STACKER AND/OR SHEET FEEDER FOR A PRINTER

BACKGROUND OF THE INVENTION

1. Field of the Invention

The invention relates to a sheet stack handler for a printer, a printer comprising such a sheet stack handler, and a method of stacking and/or feeding sheets onto and/or from a stack.

2. Description of Background Art

Sheet stack handlers are applied in sheet printers to separate individual sheets from a stack for supplying these to a print station for printing and/or forming a stack from printed sheets received from a print station. Such a sheet stack handler comprises:

- a sheet stacker and/or sheet feeder;
- a individual sheet engager comprising a sheet-to-stack supplier for stacking a sheet onto a stack of sheets on one of a first and second, liftable stack supports and/or a sheet-from-stack separator for separating a sheet from a stack of sheets on one of the first and second, liftable stack supports,
- a lift assembly configured for moving the first and second, liftable stack supports between a bottom position and a top position, such that a top sheet of a stack of sheets on the first or second, liftable stack support is positionable at a level of the individual sheet engager, wherein the top position is adjacent the individual sheet engager and the bottom position is spaced apart from the individual sheet engager in a lifting direction of the first or second, liftable stack support, such that a stack holding volume is defined between the top and bottom positions.

One liftable stack support is lowered or raised dependent on whether sheets are separated or added to the stack on the liftable stack support, so that the top surface of the stack is at the operative level where the individual sheet engager can add sheets to and/or separate sheets from the stack. The stack holding volume defines a limit for a maximum height and/or of sheets that may be separated from or stacked on the first, liftable stack support. When its limit or maximum capacity has been reached, this liftable stack support is unavailable for supplying or stacking further sheets. To continue printing until this liftable stack support has been available again, an alternative location for supplying or stacking sheets is required, for example in the form of a second sheet stack handler which bypasses the first. Such an additional device however increases the costs and footprint of the printer. This is particularly disadvantageous when the printer is arranged to handle large formats of sheets, such as A1/B1 or A2/B2 sized sheets. Such larger sheets are often provided in stacks on pallets, which prevent new sheets to be easily added from the top, as can be done in certain home/office printers.

EP3594155 A1 discloses a sheet feeding module with two rotational arms, each comprising a stack support for a stack of sheets. Both stack supports are moveable in the vertical direction as well as rotational in the horizontal plane, such that the stack supports may change places in a continuously, cyclic motion.

U.S. Pat. No. 5,011,126 A discloses a sheet feeding module with a vertically movable stack support and horizontally movable pins on opposing sides of the stack support. The pins may be inserted into a stack on the stack support to bear a top portion of the stack, while the lower stack support returns to its starting position.

SUMMARY OF THE INVENTION

It is an object of the invention to provide an alternative or improved sheet stack handler for a printer, preferably one with a relatively simple and/or low-costs construction, and/or a relatively small footprint.

In accordance with the present invention, a sheet stack handler, a printer, and a method are provided.

The sheet stack handler comprises:

- a sheet stacker and/or sheet feeder;
- a first and a second liftable stack support, each configured to support a stack of sheets, preferably provided on a pallet;
- a individual sheet engager for stacking a sheet onto a stack of sheets one of the first or second, liftable stack supports and/or separating a sheet from a stack of sheets on one of the first and second liftable stack supports;
- a lift assembly for moving the first or second liftable stack support between a bottom position and a top position, which are respectively positioned spaced apart from and adjacent the individual sheet engager, such that a stack holding volume is defined between the bottom position and top position, and wherein the lift assembly is further configured to position a top sheet of the stack and/or on the first or second, liftable stack support inside the stack holding volume at an operative level of the individual sheet engager, such that the individual sheet engager can stack a new sheet onto the top sheet and/or separate the top sheet from the respective stack, The sheet stack handler further comprises a translation mechanism configured to translate at least one of the first and second, liftable stack supports while supporting a stack of sheets between a buffer position outside of and on one side of the stack holding volume and an active position inside the stack holding volume.

The translation mechanism is adapted to bring the first or second, liftable stack support into and/or out of the stack holding volume, while holding a stack of sheets on the respective liftable stack support. Thereby, a stack can be moved into and/or out of the stack holding volume via a compact, translational path, for example formed by a sliding trajectory. Outside of the stack holding volume, the respective liftable, stack support is in close proximity to the side of the stack holding volume. This adjacent positioning combined with the translational movement results in a compact device which has a relatively small footprint. When the liftable stack support inside the stack holding volume has reached its capacity (i.e. is empty or stacked up to its maximum height), the other liftable, stack support can be quickly and efficiently inserted into the stack holding volume, such that operations may be continued with minimal delay due to the stack exchange. The liftable, stack support in the buffer position is outside of the stack holding volume and thereby easily accessible for the sideways loading and unloading of pallets thereon. Thereby, the object of the present invention has been achieved.

More specific optional features of the invention are indicated in the dependent claims.

In an embodiment, the lift assembly comprises a first lift for lifting and/or lowering the first, liftable stack support and a second lift for lifting and/or lowering the second, liftable stack support independent of the first, liftable stack support.

Each stack support is provided with its individual lift that allows one stack support to be raised and or lowered independent of the other stack support. This allows for a quick stack exchange for example by positioning the stack support in the buffer position at the operative level before inserting it into the stack holding volume. The lifting or lowering may be performed during the translational motion as well to save time. It further may allow the stack supports to be moved out of one another's way prior to or during translation.

In an embodiment, the individual sheet engager is configured to transport sheets in a transport direction parallel to a transport path for feeding sheets to and/or receiving sheets from the individual sheet engager, and wherein a translation direction of the translation mechanism is perpendicular to the transport direction and to the lifting direction. The transport path extends in the transport direction, which is preferably the direction wherein sheets are moved onto or from the stack by means of the individual sheet engager. The stack supports are translatable parallel to their support surfaces in a direction perpendicular to the transport direction. During operation, the transport direction and the translation direction are preferably horizontal direction. Thereby, the buffer position or positions are positioned at a lateral side of the stack holding volume with respect to the transport direction. This allows the stack support in the buffer position to be easily accessible.

In an embodiment, the translation mechanism is configured to move the one of the first or second, liftable stack supports back and forth along a straight, linear trajectory between the active position and the buffer position. The active position is inside the stack holding volume and underneath or overlapping with the supplying and/or separating module, when viewed in the lifting direction. The buffer position is to a side of, adjacent, and/or neighboring the active position, preferably without overlapping. The translation mechanism is arranged to move a stack support from the buffer position to the active position and/or vice versa along the shortest route. This reciprocal movement allows for a small footprint.

In an embodiment, the translation mechanism comprises a translation frame that connects the first, liftable stack support to the second, liftable stack support, such that first and second liftable stacks support move in unison in a translation direction of the translation mechanism. The first and second, liftable supports are provided together on the sliding frame, which rigidly couples the first and second, liftable supports together in the translation direction of the frame. When one of the liftable stack supports is moved from a buffer position to the active position, the other stack support moves from the active position to a buffer position, and vice versa.

In an embodiment, two buffer positions are provided on opposite sides of the stack holding volume, such that moving one of the of the first and second, liftable stack supports from one of the buffer positions to the active position moves the other of the first and second, liftable stack support from the active position to the other of the buffer positions. The sliding frame is reciprocally movable between a first and second position, such that alternatingly the stack supports are moved into the active position in the stack holding volume. Each stack support has its own buffer position, which are located on opposite sides of the stack holding volume in the translation direction.

In an embodiment, the second, liftable stack support is movable in a direction perpendicular to lifting directions of both the first and second, liftable stack supports between the buffer position outside and on one side of the stack holding volume and the active position inside the stack holding volume over the first, liftable stack support, such that the individual sheet engager is able to stack and/or separate sheets on and/or from a stack of sheets on the second, liftable stack support. While the first, liftable stack support is actively used, the second, liftable stack support is positioned to a single side of the stack holding volume when in the buffer position. When a capacity of the first, liftable support has been reached, it is at or moved to its bottom position, thereby creating a free space over the first, liftable support in the stack holding volume, where the second, liftable support is then inserted into its active position in the stack holding volume. The second, liftable support in its active position is positioned over the first, liftable support and is available for feeding sheets from or stacking sheets onto it by appropriately controlling its position in the lifting direction. Thereby, the second, liftable support is kept at the appropriate level with respect to the individual sheet engager, similar to the first, liftable stack support when that was used for supplying and/or stacking sheets. As such, a time window for providing a new stack on or removing a stack from the first, liftable support is created by using the capacity of the second, liftable support. The construction is relatively simple and low costs, since the second, liftable support utilizes the same individual sheet engager as the first, liftable support, without any requiring any adjustments to the individual sheet engager. A relatively small footprint is achieved by the during use horizontal motion of inserting the second, liftable support into the stack holding volume from a single side of the stack support. This also allows the module to be used as both a stacking module and a feeding module, since the second, liftable support can hold its own stack while in the buffer position.

In an embodiment, the second, liftable support is configured for holding a second stack of sheets while in the buffer position. For stacking purposes, the second, liftable support is able to move a stack on it to outside the stack holding volume to the buffer position. For feeding purposes, the second, liftable support can hold a second stack in the buffer position and bring it from the buffer position into the stack holding volume. This allows the individual sheet engager to utilize the second, liftable support to continue printing operations, while the first, liftable support is cleared or re-stocked. Preferably, the buffer position is on an opposite side of the stack holding with respect to a transport path for transporting sheets to and/or from the individual sheet engager, though the buffer position may be provided at one of the remaining lateral sides of the stack holding volume as well. A different side of the stack holding volume is free or open for inserting and/or removing a stack of sheets, preferably a stack provided on a pallet. As most sheet types in printing are rectangular, the stack holding volume is usually rectangular as well, when viewed in the vertical direction during use.

In an embodiment, the second, liftable stack support is configured to move into and/or out of the stack holding volume while holding a stack of sheets, wherein the second, liftable stack support with the stacks of sheets on it moves over the first, liftable support in a direction perpendicular to the lifting directions of both liftable, stack supports. The second, liftable stack support is arranged to hold a stack of sheets when within the stack holding volume and also in the buffer position while outside the stack holding volume, as well as when moving into and/or out of the stack holding volume. Thereby, the second, liftable stack support is able to move a stack into and/or out of the stack holding volume while the first, liftable stack support is at a lower position beneath the second, liftable stack support.

In an embodiment, the lifting directions of the first and second liftable stack supports are parallel to one another. During use, both lifting directions are preferably extending in or parallel to the vertical direction.

In an embodiment, the sheet stack handler further comprises a first lift for moving the first, liftable stack support between the bottom and top positions and a second lift for lowering and raising the second, liftable stack support independently of the first lift, wherein the second, liftable stack support is dimensioned and positioned be inserted into the stack holding volume without contacting the first lift, at least between the top and bottom positions. The first lift preferably engages the first, liftable stack support outside and/or at the sides of the stack support surface. The first lift at least within the stack holding volume is positioned and spaced apart from the second, liftable stack support, such that the second, liftable stack support and optionally also its second lift is able to move in between and/or fit in between the first lift in the stack holding volume. This allows the second, liftable stack support to be inserted over the first, liftable stack support without either affecting operation of the other. The first and second lifts are further arranged to operate independently from one another, such that the first liftable, stack support can be positioned and/or moved independently of the position and/or movement of the second, liftable stack support.

In an embodiment, the sheet stack handler further comprises a translation guide beam along which the second, liftable stack support is movable when moving in and out the stacking volume, wherein the translation guide beam extends parallel to a horizontal direction during use. The translation beam defines the trajectory wherein the second, liftable stack support moves into and/or out of the stack holding volume. The translation beam is preferably positioned outside the stack holding volume, but positioned and/or dimensioned to support the second, liftable stack support also when the second, liftable stack support is inside the stack holding volume. It will be appreciated that the second lift may be provided to move with the second, liftable stack support and/or are arranged to control the height of the lifting beam and thereby the height of the second, liftable stack support. In another example, the second, liftable stack support remains at a stationary position and the sheet stack handler is arranged to compensate to the changing height of the stack, at least within a smaller range as compared to the range of the first, liftable stack support.

In an embodiment, the second lift is substantially positioned outside the stack holding volume when the second, liftable stack support has been inserted into the stack holding volume. A rigid connection attaches the second lift to the second, liftable stack support in the stack holding volume. To maintain a small vertical footprint, the second lift remains outside of the stack holding volume. This allows the first lift to be positioned directly at the edges of a stack support surface of the first, liftable stack support. The stack support surface has dimensions similar or equal to the dimensions of the largest sheet format to be applied. In another embodiment, the second, liftable stack support does not overlap with lifting lines of the first lift, when viewed in the vertical direction. The lifting lines are connected to a drive and the first, liftable stack support is raised and lowered by winding and unwinding the lifting lines.

In an embodiment, the sheet stack handler further comprises a controller configured to determine when a number of sheets in the stack on the first, liftable stack support matches or crosses a predetermined threshold, to then control the first, liftable stack support to be positioned at the bottom position, followed by controlling the second, liftable stack support to be inserted into the stack holding volume, and to transmit stack support capacity information for prompting said information on a user interface. The controller determines when capacity of the first, liftable support has been exceeded, i.e. when the stack has been emptied in case of sheet supplying and/or when the stack has reached it maximum allowed height in case of sheet stacking. The predetermined threshold can be expressed in any suitable manner, such as a number of sheets or a height. In the case of sheet supplying the threshold is for example zero sheets or 0 mm or microns, and when the threshold has been reached, the first, liftable support is controlled to move the second, liftable support into the stack holding volume after lowering the first, liftable stack support. Additionally, the operator is informed that a loading or unloading operation is required for the first, liftable stack support via the prompt at the user interface. The prompt may include an estimated time before the capacity of the second, liftable support will be reached. For example, the controller is configured to apply information regarding a number of sheets on the second, liftable stack support to prompt on the user interface time information indicating an estimated period until the stack on the second, liftable stack support will be depleted.

In another embodiment, the controller further determines at which first side of the stack holding volume the first or second liftable stack support is positioned, so that upon determining that the predetermined threshold has been matched or crossed, the said first or second liftable stack support is moved into the stack holding volume, thereby moving the other of the first or second liftable stack supports is moved into a buffer position on a second side of the stack holding volume opposite the first side. The first and second stack supports move in coupled motion reciprocally through the stack holding volume. During printing, one of the stack supports is in a buffer position one side of the stack holding volume for loading or unloading a pallet. The controller determines at which side of the printer the stack support for (un)loading is located. When the pallet in the stack holding volume requires replacement, this stack support in the buffer position is moved into the sack holding volume. Since the other stack support is rigidly connected to the first in the translation direction, this moves the other stack support into a buffer position on an opposite side of the stack holding volume, so that a pallet can there be loaded or unloaded. The movement is then reversed when another pallet replacement is required.

The present invention further relates to a printer comprising a sheet stack handler as described above. The printer is preferably an inkjet printer comprising a substantially linear or straight transport path section extending between the sheet feeding module and the sheet stacking module, such that relatively large format, rigid sheets such as carton can be easily transported and printed.

The present invention further relates to a method for stacking and/or feeding sheets onto and/or from a stack, the method comprising the steps of:

controlling a height position of a first, liftable stack support, such that a top sheet of a stack on the first, liftable stack support is at an operative level at an individual sheet engager, such that the individual sheet engager can stack and/or supply a sheet onto and/or from the stack on the first, liftable stack support;

moving along a straight trajectory a second, liftable stack support from a buffer position adjacent and to a side of the stack holding volume into the stack holding volume;

controlling a height position of the second, liftable stack support independent of a height position of the first, liftable stack support, such that a top sheet of a stack and/or a top surface on the second, liftable stack support is at an operative level at the individual sheet engager; and by means of the individual sheet engager stacking and/or separating a sheet onto and/or from the stack on the second, liftable stack support.

The method may be performed on the device as described above to achieve an efficient manner of stack or supplying sheets to or from a printer. In an embodiment, the second, liftable stack support slides over the first, liftable stack support in the stack holding volume or the step of sliding comprises moving the first and second, liftable stack supports in coupled movement in a translation direction.

In an embodiment, the step of the first and second, liftable stack supports in coupled movement comprises moving the first stack support from a first buffer position on a first side of the stack holding volume to an active position in the stack holding volume while simultaneously moving the second stack support from the active position to a second buffer position on a second side of the stack holding volume opposite the first buffer position and/or vice versa. The stack support may be provided on a common sliding frame. By moving the sliding frame back and forth, one stack support is moved into the stack holding volume, while the other is moved out of the stack holding volume into its respective buffer position.

In an embodiment, the method further comprises the step of adjusting a height of one of the stack support in its buffer position to an operative level of the individual sheet engager. Before moving into the stack holding volume, the respective stack support is raised to the level where the stack on it can be utilized by the individual sheet engager. This reduces the exchange time.

The present invention further relates to a method for stacking and/or feeding sheets onto and/or from a stack, the method comprising the steps of:

controlling a height position of a first, liftable stack support, such that a top sheet of a stack on the first, liftable stack support is at an operative level at a individual sheet engager, such that the individual sheet engager can stack and/or supply a sheet onto and/or from the stack on the first, liftable stack support;

lowering the first, liftable stack support when determining that a height of the stack reaches or crosses a predetermined threshold;

sliding a second, liftable stack support over the first liftable, stack support;

controlling a height position of the second, liftable stack support, such that a top sheet of a stack on the second, liftable stack support is at the operative level at the individual sheet engager, such that the individual sheet engager can stack and/or supply a sheet onto and/or from the stack on the second, liftable stack support positioned over the first, liftable stack support; and providing a new stack on the first, liftable stack support, such that the new stack is positioned between the first and second liftable, stack supports and/or removing a stack on the first, liftable stack support from between the first and second liftable, stack supports. In an embodiment, the method further comprises the step of retracting the second, liftable stack support, such that the first, liftable stack support on it is free to move towards the operative level. The top of the stack or the empty stack support surface is positioned at the operative level. In another embodiment, the second, liftable stack support slides over the first, liftable stack support directly upon the first liftable, stack support passing the second, liftable stack support. Preferably, the first and second, liftable stack supports move in a vertical direction and the second, movable stack support slides in a horizontal direction. For example, a starting height of the stack on the first, liftable stack support may be greater than that of the stack on the second, liftable stack support. As the second, liftable support acts as a temporary buffer the stack provided or formed thereon is smaller than that on the first, liftable support.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
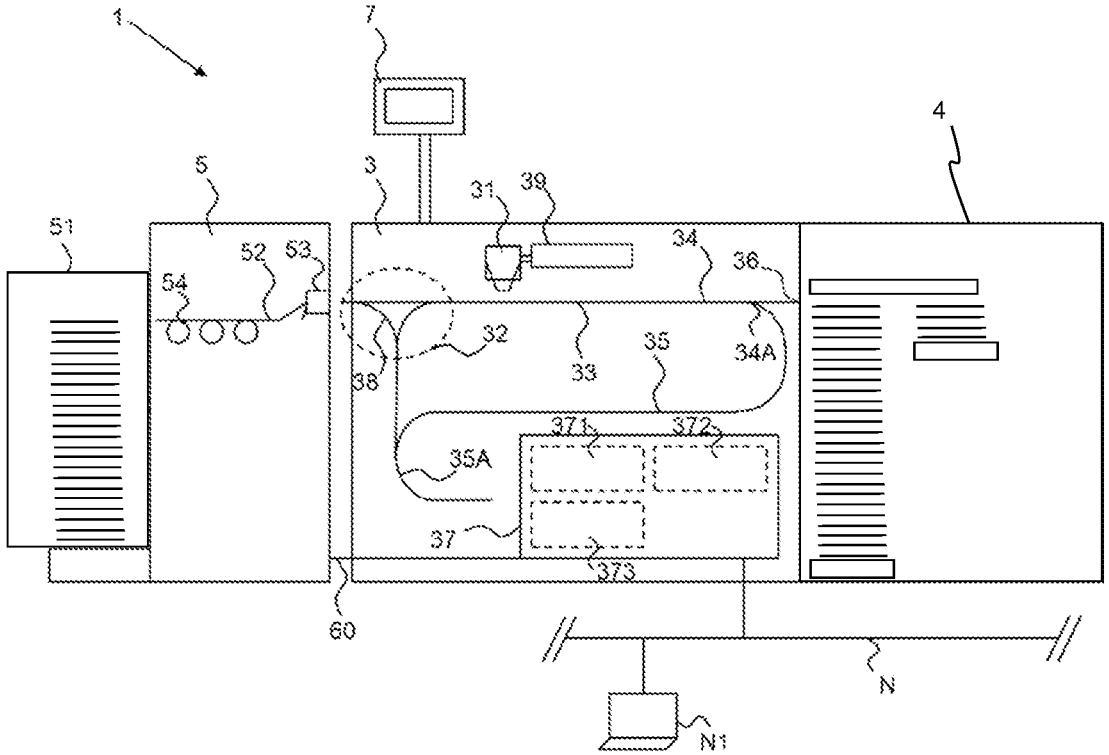
FIG. 1 is a schematic side view of a sheet printer according to the present invention.

The present invention will now be described with reference to the accompanying drawings, wherein the same reference numerals have been used to identify the same or similar elements throughout the several views.

Printer

FIG. 1 shows schematically an embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet print system, an electrographic print system, etc.

The output section 5 comprises an output holder for holding printed image receiving material, for example a plurality of sheets. The output section 5 may comprise a further output holders. The printed image receiving material is transported from the print engine and control section 3 via an inlet 53 to the output section 5 via the rollers 54 of the output transport path 52. The output holder is comprised in a sheet stacking module, which stacks sheets received from the output transport path 52 into a stack on the output holder.

The print engine and control section 3 comprises a print engine and a controller 37 for controlling the printing process and scheduling the plurality of sheets in a printing order before they are separated from a stack at the input section 4.

The controller 37 is a computer, a server or a workstation, connected to the print engine and connected to the digital environment of the printing system, for example a network N for transmitting a submitted print job to the printing system 1. In FIG. 1 the controller 37 is positioned inside the print engine and control section 3, but the controller 37 may also be at least partially positioned outside the print engine and control section 3 in connection with the network N in a workstation N1.

The controller 37 comprises a print job receiving section 371 permitting a user to submit a print job to the printing system 1, the print job comprising image data to be printed and a plurality of print job settings. The controller 37 comprises a print job queue section 372 comprising a print job queue for print jobs submitted to the printing system 1 and scheduled to be printed. The controller 37 comprises a sheet scheduling section 373 for determining for each of the plurality of sheets of the print jobs in the print job queue an entrance time in the paper path of the print engine and control section 3, especially an entrance time for the first pass and an entrance time for the second pass in the loop in the paper path according to the present invention. The sheet scheduling section 373 will also be called scheduler 373 hereinafter.

The sheet scheduling section 373 takes the length of the loop into account. The length of the loop corresponds to a loop time duration of a sheet going through the loop dependent on the velocity of the sheets in the loop. The loop time duration may vary per kind of sheet, i.e. a sheet with different media properties.

Resources may be recording material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode and partially in a duplex mode.

The print head or print assembly 31 is suitable for ejecting and/or fixing marking material to image receiving material. The print head or print assembly 31 is positioned near the paper path section 34. The print head or print assembly 31 may be an inkjet print head, a direct imaging toner assembly or an indirect imaging toner assembly.

While an image receiving material is transported along the paper path section 34 in a first pass in the loop, the image receiving material receives the marking material through the print head or print assembly 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop. The sheets coming from the paper path section 35 are starting their second pass along the print head or print assembly 31 in the loop. When a sheet has passed the print head or print assembly 31 for the second time in the second pass, the sheet is transported to the inlet 53 of the output section 5.

The input section 4 may include one or more sheet feeding modules, which each comprise at least one input holders for holding the image receiving material before transporting the sheets of image receiving material to the print engine and control section 3. Sheets of image receiving material are separated by a sheet separating module from an input holder and guided by guiding means 42, 43, 47 to the print engine and control section 3. Each input holder may be used for holding a different kind of image receiving material, i.e. sheets having different media properties.

The local user interface 7 is suitable for displaying user interface windows for controlling the print job queue residing in the controller 37. In another embodiment a computer N1 in the network N has a user interface for displaying and controlling the print job queue of the printing system 1.

Example 1

Figure 2:
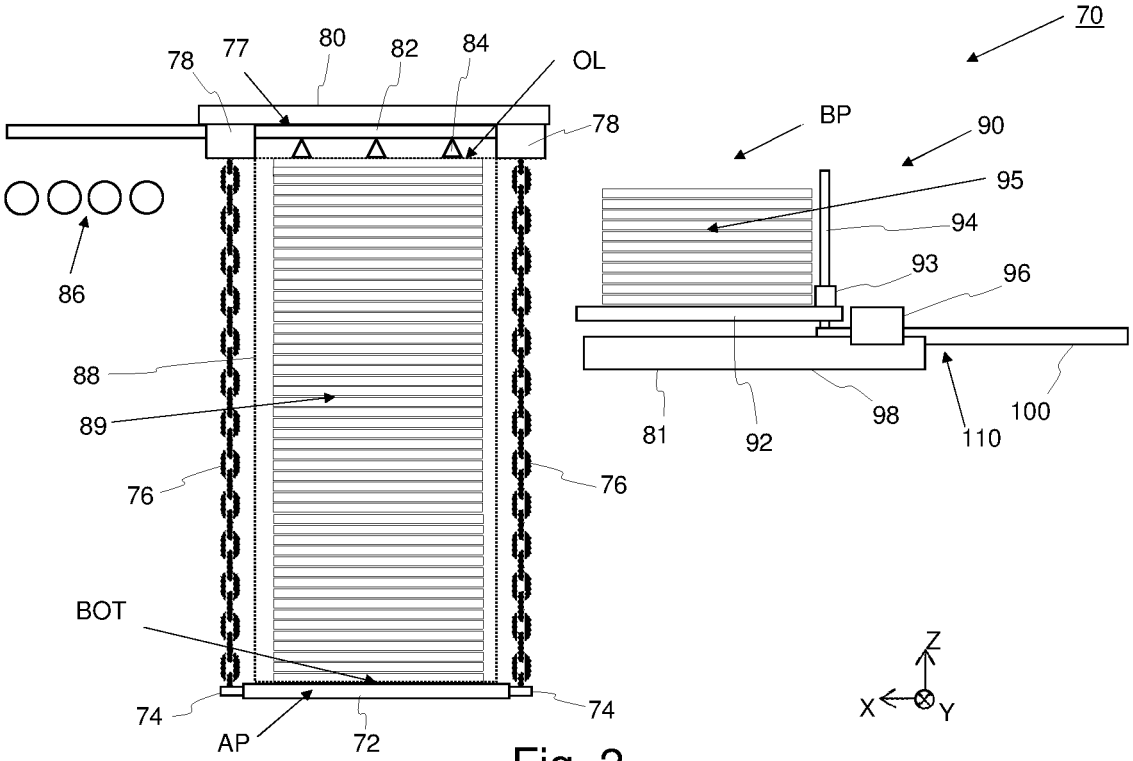
FIG. 2 is a schematic side view of a sheet supplying device of the printer in FIG. 1.

FIG. 2 illustrates a sheet feeding module 70 as comprised in the input section 4. It will be appreciated that the stack handling device shown in FIG. 2 can also be applied as a sheet stacking device at the output section 5, as will be explained with respect to FIG. 9. The sheet feeding module 70 comprises a first, liftable stack support 72 for holding a first stack of sheets 89. The first, liftable stack support 72 is preferably dimensioned for holding a pallet loaded with a stack of sheets, so its stack support surface is preferably at least that of a standard pallet or half pallet size, e.g. at least 1200×800 mm or respectively 800×600 mm. The first, liftable stack support 72 is connected via attachments 74 to a first lift. The first sin the example of FIG. 2 comprises lifting lines in the form a lifting chain 76 coupled to a drive 78 for raising and lowering the first, liftable stack support 72 in the lifting direction, which is parallel to the vertical direction Z. Other lifts, such as a vertical actuator, or a rack and pinion system may also be applied. The first lift is arranged to move the first, liftable stack support 72 between the bottom position BOT shown in FIG. 2 and the top position TOP shown in FIG. 4, while keeping the stack support surface horizontal. The imaginary volume between the bottom position BOT and the top position TOP is indicated by the dashed line in FIG. 2 to illustrate the stack holding volume 88. The first lift is controlled to move the first, liftable stack support 72 through the stack holding volume 89, such that the top sheet in the first stack 89 is kept at the operative level OL of the sheet separating module 77.

The sheet separating module 77 is configured to engage and hold a top sheet from the first stack 89 to transport it onto a transport path 86. The sheet separating module 77 in FIG. 2 comprises one or more holding devices 84, which locally hold a portion of the sheet by means of a negative pressure. While holding said sheet, the suction devices 84 are moved in the transport direction X by the guiding device 82 until the sheet is over the transport path 86. There, the holding device 84 releases the sheet, after which the sheet is transported further by the rollers of the transport path 86 in the transport direction X. In the example of FIG. 2, the holding device 84 is formed of one or more suction devices, such as suction cups or a suction transport belt. Other holding devices may be applied, as well as separation aid devices, such as blowers or pinchers, which assist in separating the top sheet from the stack 89. In another embodiment, the holding device may be formed as an endless transport belt with a suction device for drawing sheets against the belt.

The first lift and the sheet separating module 77 are attached to the frame 80. The frame 80 secures the sheet feeding module 70 to ground and provides a rigid, stationary reference with respect to which e.g. the liftable, stack supports 72, 92 are moved.

The sheet feeding device 70 further comprises an auxiliary stack holding device 90. The auxiliary stack holding device 90 comprises a second, liftable stack support 92 configured for holding a second stack of the sheets 95. The second, liftable stack support 92 has similar dimensions as the first, liftable stack support 72, so that both can hold the same type of sheets (i.e. having the same dimensions and/or same materials). Both have at least an equally large area for stack support surface. In FIG. 2, the second, liftable stack support 92 is positioned in its buffer position B outside the stack holding volume 88, so that it does not interfere with sheet separation from the first, liftable stack support 72.

The second, liftable stack support 92 is arranged to move from its buffer position BP into the stack holding volume 88 by means of the translation mechanism 110. The translation mechanism 110 comprises a horizontal drive 96. The horizontal drive 96 is configured to translate the support 100 bearing, upon which the second, liftable stack support 92 is mounted, in the transport direction X into the stack holding volume 88. Thereby, the support bearing 100 is guided along the frame portion 81. Additionally, a second lift is provided to move the second, liftable stack support 92 in the vertical direction Z with respect to the support bearing 100. In FIG. 2, the second lift comprises a motor 93 mounted on a screw axis to raise and lower the second, liftable stack support 92. Other suitable lifts may be applied. It will be appreciated that the auxiliary stack holding device 90 in a different embodiment may also be positioned at a lateral side, such that it moves in the direction Y into and out of the stack holding volume 88. Another side of the stacking holding volume 88 is open, so that it is accessible for passing a pallet with a stack of sheets into or out of the stack holding volume 88.

Figure 3:
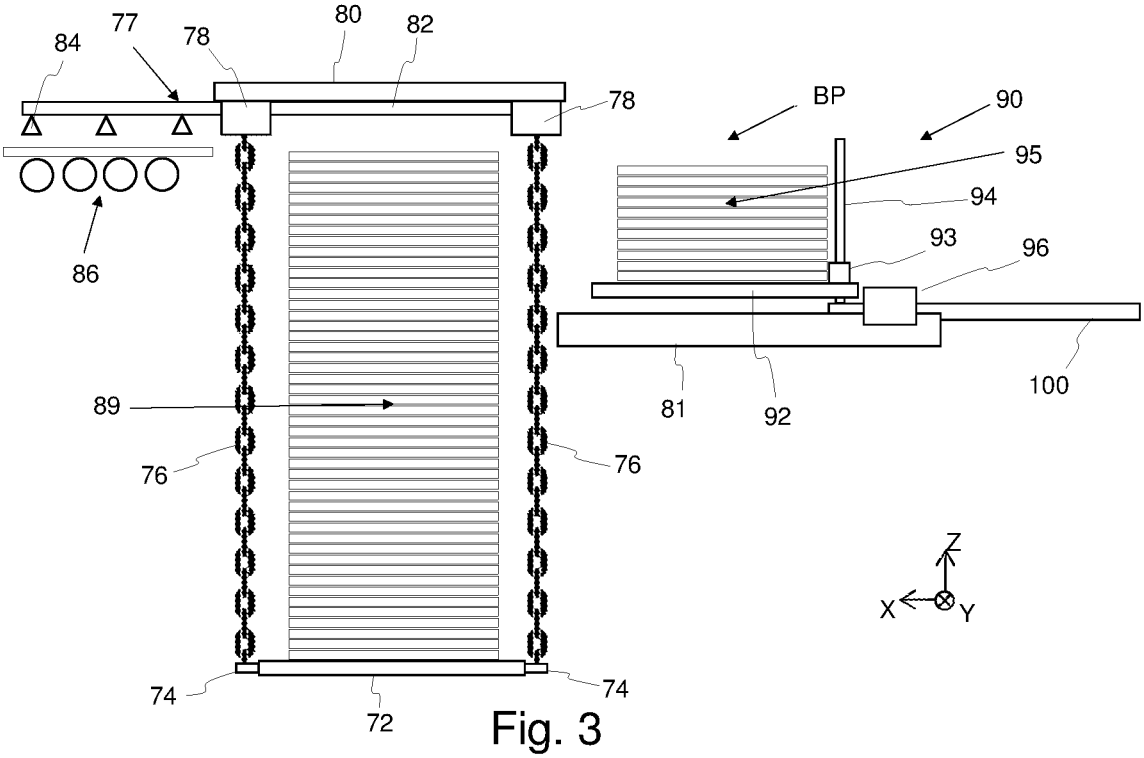
FIG. 3 is a schematic side view of the sheet supplying device of the printer in FIG. 1 in the step of supplying a sheet.
Figure 4:
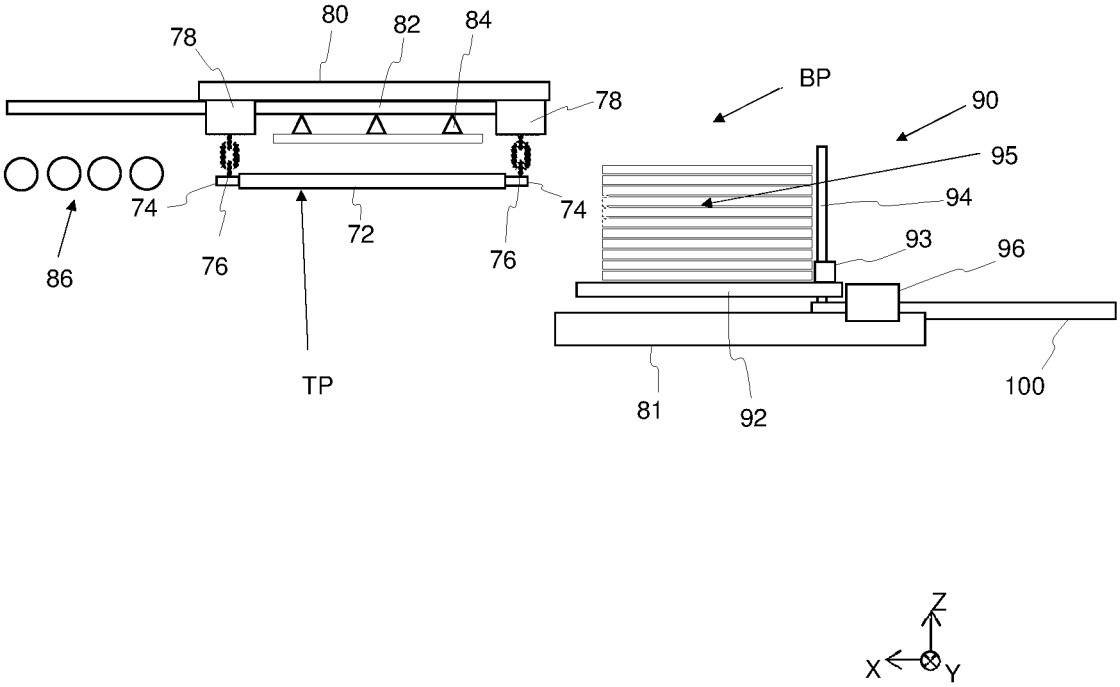
FIG. 4 is a schematic side view of a first embodiment of the sheet supplying device of the printer in FIG. 1 wherein the first, liftable stack support has been emptied.

FIG. 3 illustrates the step of separating the top sheet from the first stack 89 by means of the holding device 84. The sheet is moved in the transport direction X, so that it is positioned over the transport path 86. Thereby, the holding device 84 releases its grip on the sheet, which is then transported further along the transport path 86 towards the print assembly 31. The holding device 84 is then returned to its position at the operative level OL, so that it may separate a further sheet. Alternatively, the holding device 84 may move along an endless loop, as in the case of an endless conveyor. The first drive 78 of the first lift is activated after the separation of one or more sheets to maintain the top sheet at the operative level OL. It will be appreciated that the holding device 84 may be vertically movable to some degree and/or provide sufficiently strong suction, so that the first drive 78 of the first lift does not need to be activated after every separated sheet. The steps of separating one or more sheets and subsequently raising the first, liftable stack support 71 are repeated until the first, liftable stack support 72 is emptied, as shown in FIG. 4.

Figure 5:
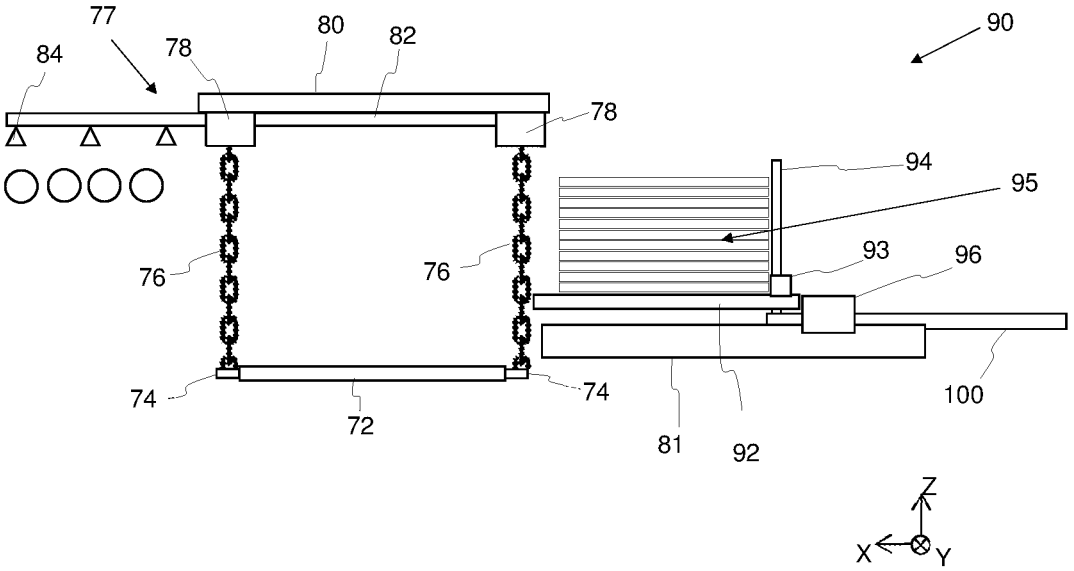
FIG. 5 is a schematic side view of the sheet supplying device of the printer in FIG. 1 wherein the second, liftable stack support is inserted into the stack holding volume.
Figure 6:
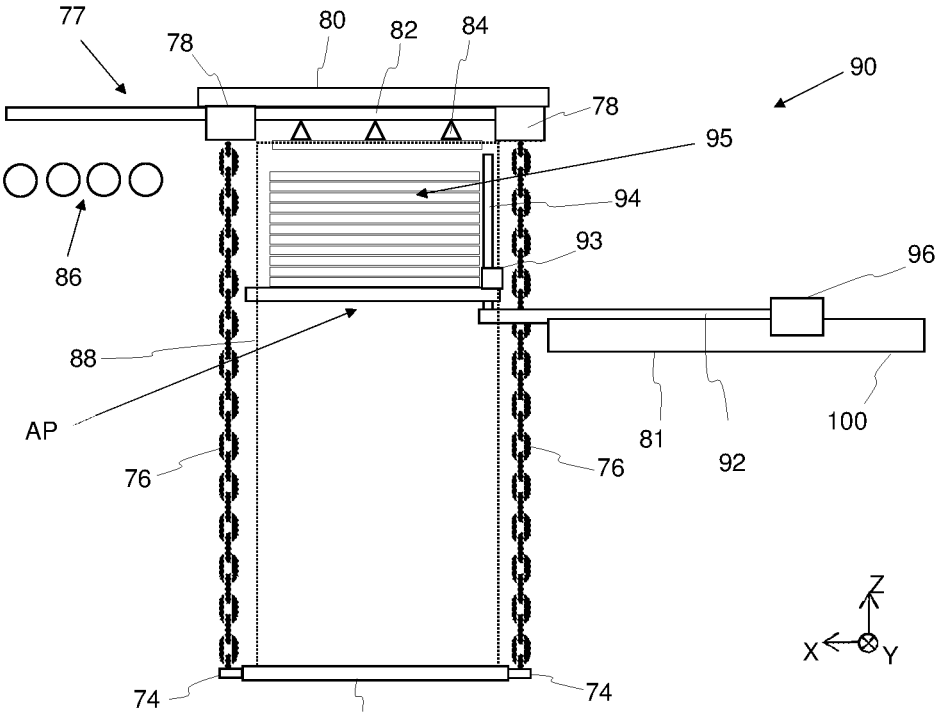
FIG. 6 is a schematic side view of the sheet supplying device of the printer in FIG. 1 wherein a sheet is supplied from the second, liftable stack support inserted into the stack holding volume.

Upon determining that the stack on the first, liftable stack support 72 has been depleted, the controller 37 controls the first lifting drive 78 to return the first, liftable stack support 72 to the bottom position BOT. When the controller 37 determines that the first, liftable stack support 72 has been lowered below the second, liftable stack support 92, the horizontal drive 96 is activated to slide the second, liftable stack support 92 towards and into the stack holding volume 88, as shown in FIGS. 5 and 6. It will be noted that the second, liftable stack support 92 is dimensioned to fit in between the first lift, specifically the chains 76, at least in the lateral direction Y, though the first and second, liftable stack supports 72, 92 have a similar sheet stack support area. The horizontal drive 96 is configured for a translational motion of the second, liftable stack support 92 in a horizontal direction X. The attachments 74 are positioned to create sufficient space between the chains 76 for the second, liftable support 92. The attachments 74 extend beyond or outside of the sheet stack support area in the lateral and/or transport directions X, Y, so that the spacing between the chains 76 is wider than the second, liftable stack support 92.

In FIG. 6, the second liftable, stack support 92 has been fully inserted into the stack holding volume 88 and is positioned at its active position AP. The second liftable, stack support 92 is positioned over the first, liftable stack support 72, which is at or moving towards the bottom position BOT. When viewed in the vertical direction Z, the second, liftable stack support 92 overlaps entirely with the first, liftable stack support 92. The second lifting drive 93 is controlled to position the top sheet of the second stack 95 at the operative level OL at the sheet separation module 77. When a single sheet is present on the first stack support 72 in the active position AP the operative level OL is preferably at and/or the same as the top position TOP.

Figure 7:
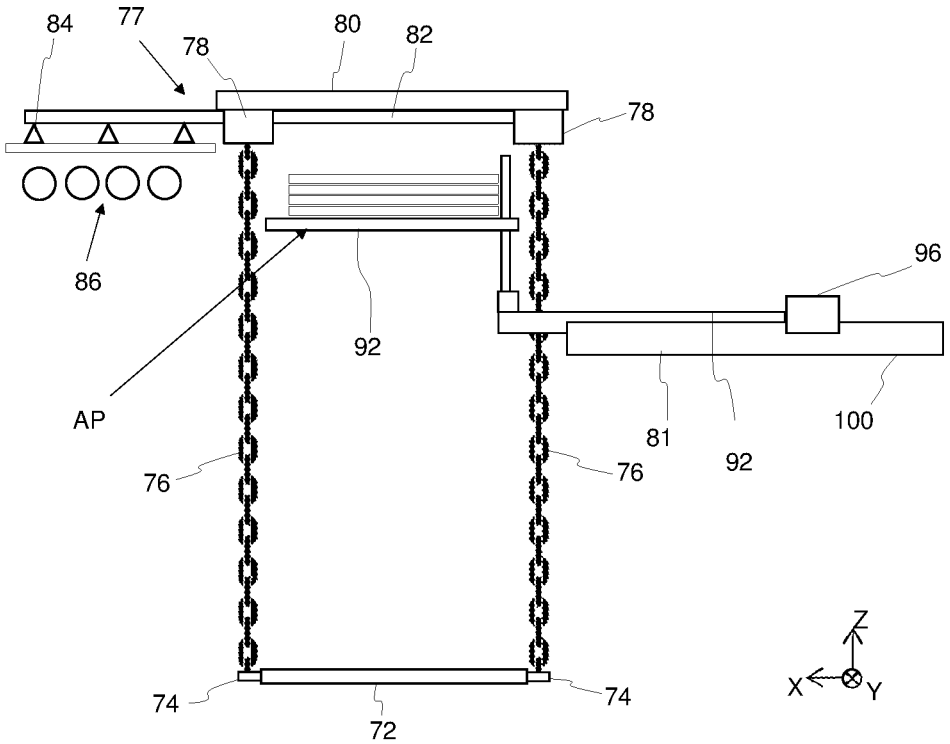
FIG. 7 is a schematic side view of the sheet supplying device of the printer in FIG. 1 wherein the first liftable, support is returned to its bottom position below the second, liftable stack support from which sheets are being supplied.

FIGS. 6 and 7 illustrate the repeated steps of separating sheets from the second stack 95, while the first, liftable stack support 72 is below the second, liftable stack support 92. In FIG. 7, the first, liftable stack support 72 has reached its bottom position BOT. The printing operation can continue substantially uninterrupted despite the first stack 89 being depleted. The second stack 95 on the second, liftable stack support 95 holds a smaller number of sheets than the first stack 89, though the second stack 95 is sufficient to overcome at least the time required for lowering the first, liftable stack support 72 and re-stocking it with a new stack. Dependent on the printing speeds, the second stack 95 creates time window of at least a few hours, wherein the first, liftable stack support 72 may be re-filled. When it has been determined that the first stack 89 has run out, the controller 37 sends a prompt to a user interface on e.g. the printer, computer, and/or mobile device to inform the operator re-stocking is required. The prompt may include an estimated time before the second stack 95 runs, based for example on the number of sheets in the second stack 95 as compared to the print speed of the printer 1.

Figure 8:
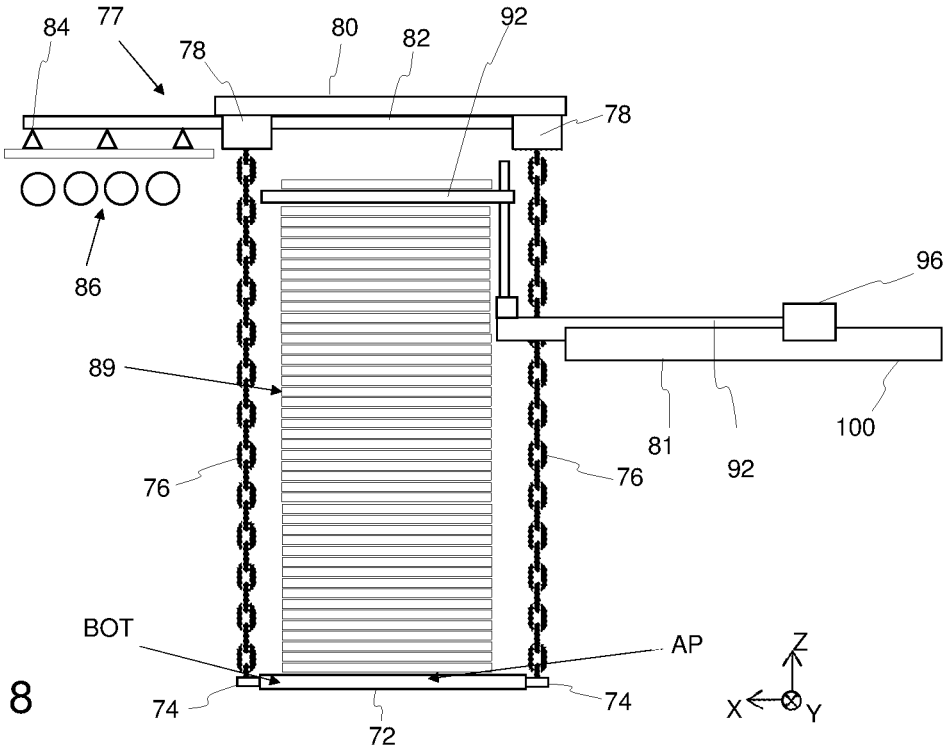
FIG. 8 is a schematic side view of the sheet supplying device of the printer in FIG. 1 wherein the first liftable, support has been provided with a new stack of sheets below the second, liftable stack support from which sheets are being supplied.

The re-stocking of the first, liftable stack support 72 is shown in FIG. 8. A new, first stack 89 is placed on the first, liftable stack support 72, while it is underneath the second, liftable stack support 92. Thus, the printing operation may continue even during the re-filling of the first, liftable stack support 72. The new, first stack 89 is placed in the stack holding volume 88 between the first and second, liftable stack supports 72, 92. It will be appreciated that an operator may also choose to first retract the second, liftable stack support 92 to its buffer position B before refilling the first, liftable stack support 72. Either way, the second, liftable stack support 92 is eventually returned at its buffer position BP when or after the new, first stack 89 has been provided on the first, liftable stack support. Sheet feeding may then continue from the new, first stack 89 on the first, liftable stack support 72, as shown in FIG. 1. In the meantime, the second, liftable stack support 92 may be re-stocked with a new, second stack 95. The above described steps may then be repeated.

Example 2

Figure 9:
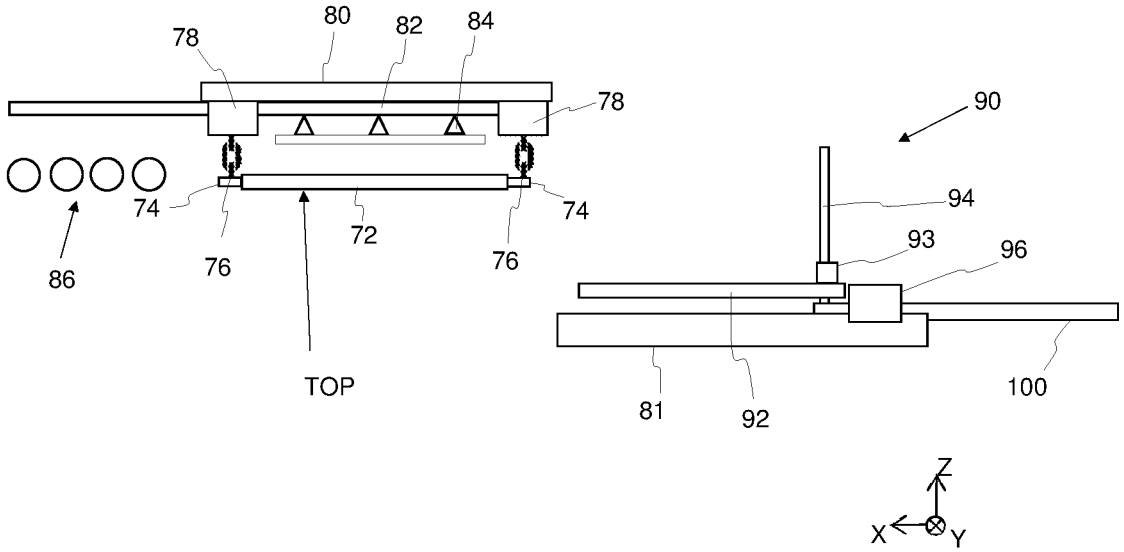
FIG. 9 is a schematic side view of a sheet stacking device of the printer in FIG. 1 in the step of stacking a first sheet on the first liftable, support.
Figure 10:
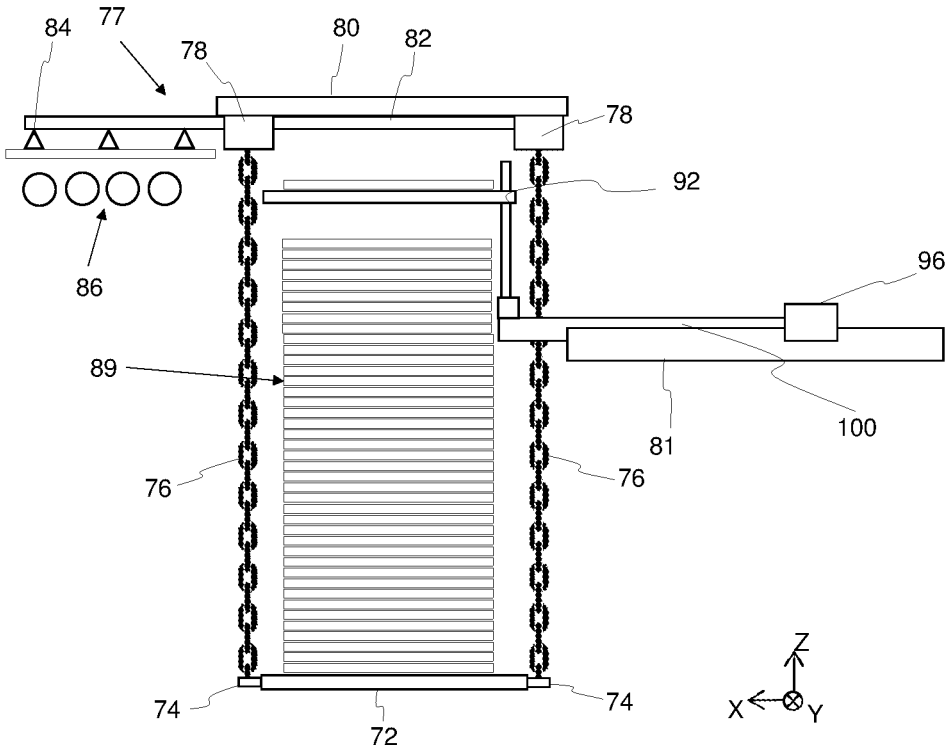
FIG. 10 is a schematic side view of the sheet stacking device in FIG. 9, in the step of inserting the second, liftable support over the first liftable, support, when the latter reaches its maximum capacity'

FIGS. 9 and 10 illustrate the operation of the stack handling device in FIG. 2 acting as a sheet stacking module. The sheet separation module 77 herein acts as a sheet stacking module 77, which picks up sheets from the transport path 86 and moves these towards the operative level OL. There, the sheet is released onto the stack 89 below. In FIG. 9, the first sheet of a new, first stack 89 is deposited on the first, liftable stack support 72. The first, liftable stack support 72 starts in the top position TP and it is lowered stepwise, as more sheets are added to the first stack 89. When the controller 37 determines that the first, liftable stack support 72 has reached the bottom position BOT (or that a print/stack has been completed), the second, liftable stack support 92 is inserted into the stack holding volume 88, so that the second, liftable stack support 92 is positioned over the first stack 89 on the first, liftable stack support 72. The bottom position BOT herein is selected, such that above the top sheet of the fist stack 89 on the first, liftable stack support 72 sufficient space is available for inserting the second, liftable stack support 92. A second stack can then be formed on the second, liftable stack support 92, while the operator removes the first stack 89 from the first liftable, stack support 72. Afterwards, the second, liftable stack support 92 is retracted to the buffer position B, such that stacking can be continued on the first, liftable stack support 72. After the first, liftable stack support 72 has been emptied, the second, liftable stack support 92 can be retracted to the buffer position BP and stacking can be resumed on the first, liftable stack support 72.

Example 3

Figure 11:
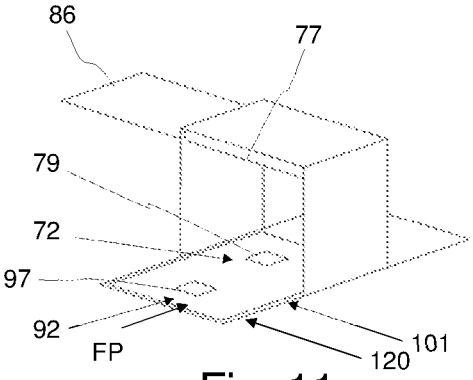
FIGS. 11 to 16 illustrate in schematic, perspective view the steps of a method of supplying sheets by means of another embodiment of a sheet supplying device for the printer in FIG. 1.

FIG. 11 illustrates another embodiment of a sheet stack handler, which in FIGS. 11 to 20 is configured to operate as a sheet feeding device. As will be discussed with regard to FIGS. 21 to 24, this configuration can also be applied as a sheet stacking device.

In FIG. 11, the first and second stack supports 72, 92 are provided together on a common sliding frame 101, which forms the translation mechanism 120. The translation mechanism 120 comprises a drive (not shown) which is arranged to move the sliding frame reciprocally between a first position FP and a second position SP. In either position FP, SP, one of the first and second stack supports 72, 92 is positioned inside the stack holding volume 88 underneath the sheet separating module 77. The drive is able to move the sliding frame back and forth between the first and second positions FP, SP, such that the first support stack 72 beneath the sheet separating module 77 is replaced with the second stack support 92 or vice versa. The sheet separating module 77 is arranged to then separate the top sheet individually from the sheet stack 89 on the respective stack support 72, 92 and place it on the transport path 86, which may then move the sheet in the transport direction X.

FIG. 11 illustrates that the frame or housing of the sheet supplying device is open on both sides in the sliding direction Y of the sliding frame 101. Thus, each stack support 72, 92 can enter and exit the housing while holding a stack of sheets. Each stack support 72, 92 further provided with its respective lift 79, 97. The lifts 79, 97 are movable independently of one another in the lifting direction Z. The lifts 79, 97 and the stack supports 72, 92 on the frame have fixed, non-overlapping positions in the translation direction. Moving the frame thus synchronously moves the lifts 79, 97 and the stack supports 72, 92 in the translation direction.

Figure 12:
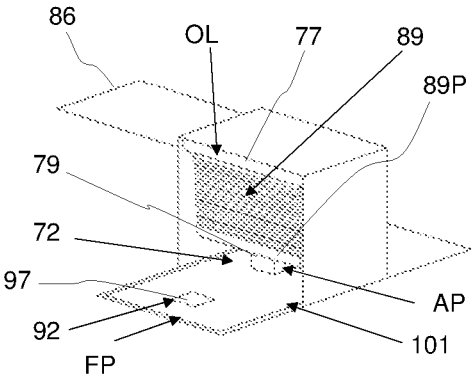

FIG. 12 illustrates the sheet supplying device in an initial operational state. A first sheet stack 89 has been provided on the first stack support 72, which is underneath the sheet separating module 77. The sheet stack 89 is provided on a pallet 72P, which pallet 72P is intermittently or continuously raised to keep the top sheet of the stack 89 at the operative level OL of the sheet separating module 77 by means of the first lift 79. Thus a stream sheets can be sent via the transport path 86 towards the printer.

The first half of the sliding frame 101 comprises the first stack support 72 and is positioned inside the housing, while a second half with the second stack support 92 is positioned outside of the housing. This allows a second pallet 95P with a second sheet stack 95 to be loaded onto the second stack support 92, as shown in FIG. 13.

Figure 13:
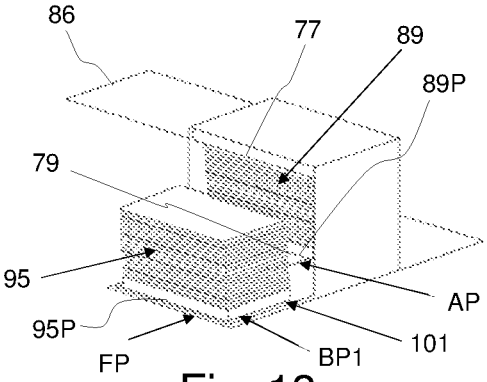
Figure 17:
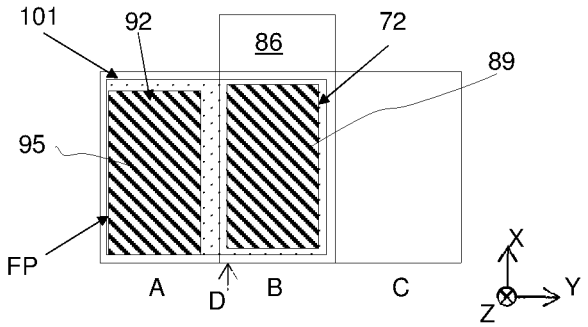
FIGS. 17 to 20 illustrate steps of the method shown in FIGS. 11 to 16 in schematic top-down view.
Figure 21:
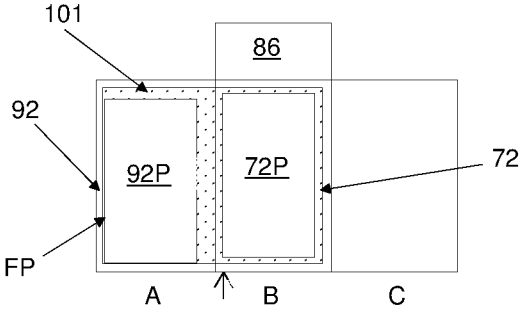
FIGS. 21 to 24 illustrate in schematic, top-down view the steps of a method of stacking sheets by means of another embodiment of a sheet supplying device for the printer in FIG. 1.

The situation in FIG. 13 is illustrated in top-down view in FIG. 17. FIG. 17 shows that the sliding area in which the sliding frame 101 moves comprises three distinct areas A, B, C. Buffer areas A, C are positioned besides and on opposite sides of the active stack area B in the sliding direction Y. The buffer areas A, C are outside of the housing, such that a pallet 72P, 92P can be taken from and/or placed on a stack support 72, 92 in the buffer area A, C. The pallet 72P, 92P may be (un)loaded by e.g. a forklift. It will be appreciated that the buffer areas A, C may still be partially shielded, as long as these are accessible from at least one side. When viewed from above in the vertical direction Z, the buffer areas A, C each correspond to and/or overlap with the respective buffer positions BP1, BP2 and the active stack area B is positioned at the active position AP.

The rigid sliding frame 101 is translatable, such that the first stack support 72 is movable between the first buffer area A and the active stack area B and the second stack support 92 is movable between the active stack area B and the other buffer area C, at least when viewed in the vertical direction Z. The sliding frame 101 rigidly couples the movement of the first stack support 72 to that of the second stack 92 in the translation direction Y. On the sliding frame 101 the first and second stack support 72, 92 have fixed relative positions. The first and second lifts are similarly fixed with respect to the one another on the sliding frame, at least in the sliding direction. When moving one of the stack supports 72, 92 to the active stack area B, the other of the stack supports 72, 92 is moved to its respective buffer area A, C. In the example here, with the sliding frame 101 in its first position FP, the first support stack 72 is in the active stack area B while the second stack support 92 is in the first buffer area A. Activating the drive of the translation mechanism 120 moves the sliding frame to its second position SP, wherein the first stack support 72 is in the second buffer area C while the second stack support 92 is in the active stack area B. The first and second lifts can be controlled independently from one another, so that the first and second stack supports 72, 92 can be set at any desired height, regardless of the position of the sliding frame 101 in the sliding direction. Since the first and second lifts are fixed to the sliding frame in the sliding direction, a stack support 72, 92 can be moved up or down as it moves towards or away from the active stack area B.

Figure 14:
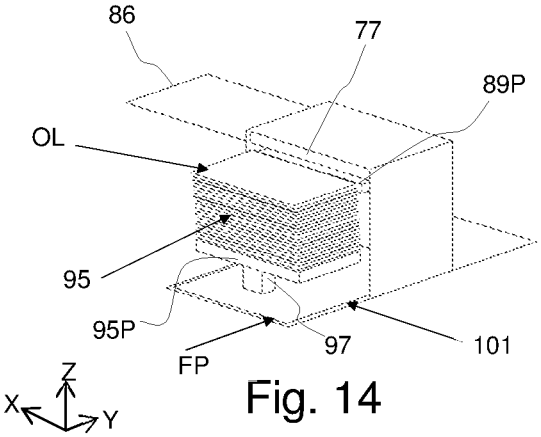
Figure 18:
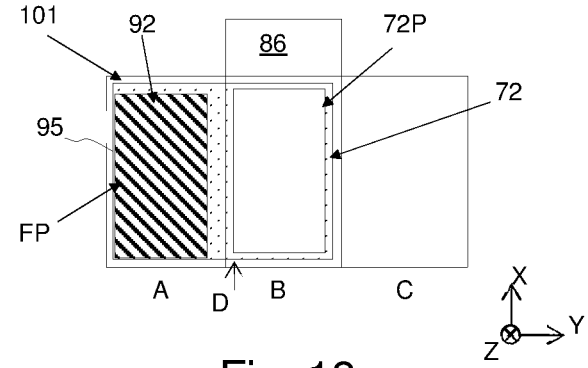

FIGS. 14 and 18 illustrate the step of depleting the first stack 89 on the first stack support 72. Before or when depleting the first stack 89, the second lift 97 is controlled to raise the second stack 95 to the operational level OL of the sheet supplying device 77. The stack exchange time is reduced by raising the second stack 95 to the correct level prior to insertion. Alternatively, the raising may be performed while the sliding frame 101 moves.

Figure 15:
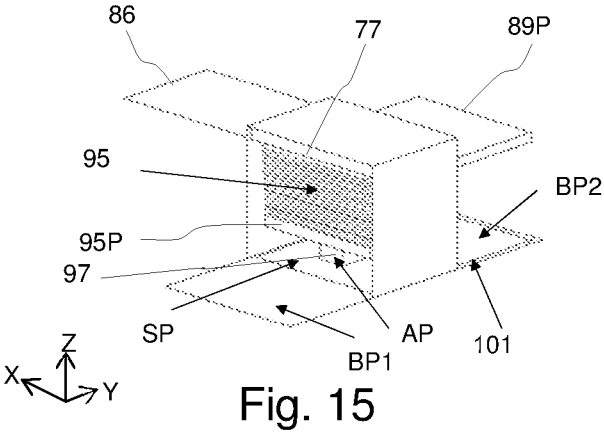
Figure 19:
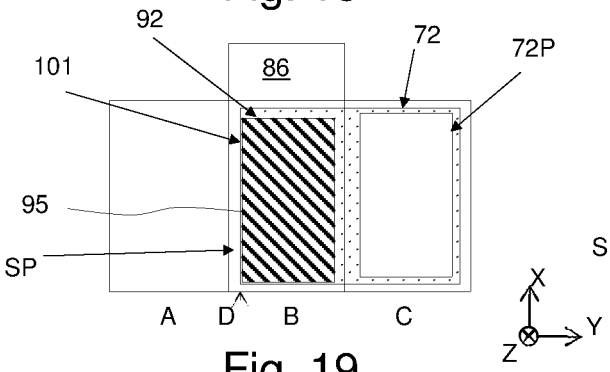
Figure 23:
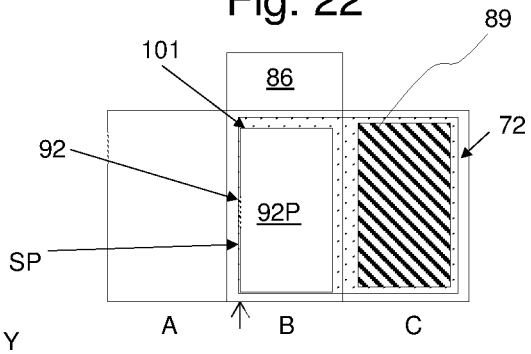

FIGS. 15 and 19 illustrate translation of the translation of the sliding frame 101 to the second position SP. The first stack support 72 slides out of the housing to the second buffer area C. The second stack support 92 simultaneously enters the housing and is positioned at the active stack position B. Note the second stack 95 is not in perfect alignment with the first stack 89. In this example, the second stack 95 has been loaded, such that is shifted slightly in both the transport direction X and the sliding direction Y with respect to the first stack 89. The translation of the sliding frame 101 is controlled, such that each stack 89, 95 is aligned with respect to a predetermined lateral reference position D (indicated with the arrow). Thereby, sheets are aligned in the lateral direction Y on the transport path 86. Deviations in the transport direction X can be corrected by controlling the movement of the sheet supplying module 77, such that sheets are supplied e.g. by having a constant inter-sheet distance. In case the stack 89, 95 is positioned in a rotated state, the rotation may also be corrected by a combined action of positioning the sliding frame 101 and the sheet separating module 77. The position of the sheet stack 89, 95 may be detected by one or more suitable sensors, such as a camera, (laser) distance sensor, or other detection means. It will be appreciated that each correction (X, Y, or skew/rotation deviations or) may be applied independent of one another. As such, each stack or pallet may be loaded relatively quickly as careful alignment during loading is not required.

Figure 16:
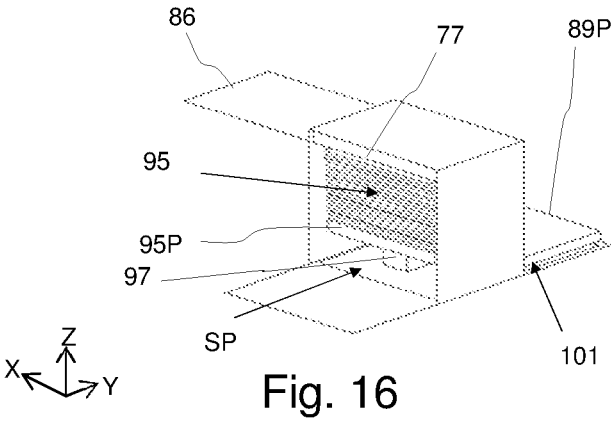
Figure 20:
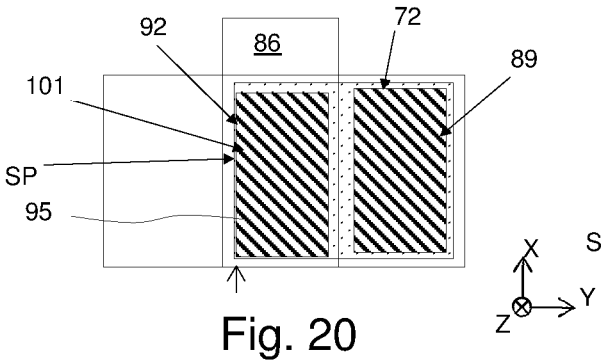

FIG. 16 illustrates the step of lowering the first stack support 72, such that a new stack 89 can be placed on it, as shown in FIG. 20. The above steps may then be repeated mutatis mutandis to continue the printing process with minimal interruption due to stack exchanges.

Example 4

Figure 24:
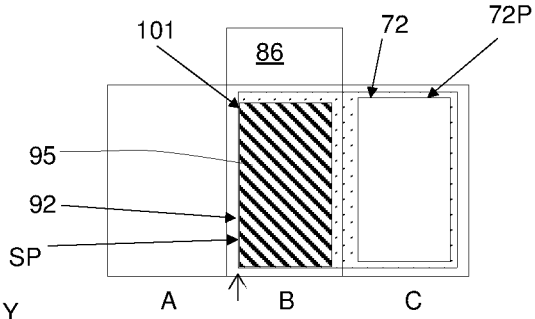

It will be appreciated that the configuration in FIGS. 11 to 16 can also be applied as a sheet stacking device, as shown in FIGS. 21 to 24. In FIG. 24, both stack supports 72, 92 comprise an empty pallet 72P, 92P. The first stack support 72 is positioned in the active stack area B and its raised and subsequently lowered to maintain the top sheets of a stack 89 thereon at the level of the sheet stacking module 77. The second stack support 92 is in the first buffer area A.

Figure 22:
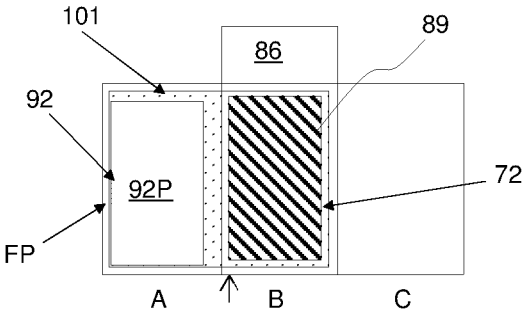

FIG. 22 shows that the first stack 89 has been completed or that the first stack support 72 has reached its maximum capacity. The translation mechanism 120 is then activated so that the first stack 89 is slid to the second buffer area C. Simultaneously, the sliding frame 101, by moving the second position SP, moves the second stack support 92 into the active stack area B. Therein the pallet 92P is aligned with respect to the lateral reference position D. Also, the second lift 97 is controlled, such that the pallet 92P is at the operational level OL of the sheet stacking module 77 at or before the sliding frame 101 reaches the second position SP and/or is aligned with respect to the lateral reference position D. Sheet stacking may then continue onto the second stack support 92. Upon reaching the capacity of the second stack support 92, the sliding frame 101 may be moved to the first position FP after an empty pallet 72P has been provided on the first stack support 72.

This application claims the benefit of EP Application No. 22215463.5, filed Dec. 21, 2022, which is hereby incorporated by reference in its entirety.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet stack handler comprising a sheet stacker and/or a sheet feeder comprising:

a first and a second, liftable stack support, each configured to support a stack of sheets;

an individual sheet engager comprising a sheet-to-stack supplier for stacking a sheet onto a stack of sheets one of the first or second, liftable stack supports and/or a sheet-from-stack separator for separating a sheet from a stack of sheets on one of the first and second liftable stack supports, wherein the individual sheet engager is configured to transport sheets in a transport direction parallel to a transport part for feeding sheets to and/or receiving sheets from the individual sheet engager, a lift assembly for moving the first and/or second liftable stack support between a bottom position and a top position, which are respectively positioned spaced apart from and adjacent the individual sheet engager, such that a stack holding volume is defined between the bottom position and top position, and wherein the lift assembly is further configured to position a top sheet of the stack on the first and/or second, liftable stack support inside the stack holding volume at an operative level of the individual sheet engager, such that the individual sheet engager can stack a new sheet onto the top sheet and/or separate the top sheet from the respective stack, wherein the lift assembly comprises a first lift for lifting and/or lowering the first, liftable stack support and a second lift for lifting and/or lowering the second, liftable stack support independent of the first, liftable stack support; and a translation mechanism configured to translate at least one of the first and second, liftable stack supports while supporting a stack of sheets between a buffer position outside of and on one side of the stack holding volume and an active position inside the stack holding volume, wherein a translation direction of the translation mechanism is perpendicular to the transport direction and to the lifting direction, and wherein the translation mechanism comprises a sliding frame that connects the first, liftable stack support to the second, liftable stack support, such that the first and second liftable stack supports are movable in unison back and forth along a straight, linear trajectory in the translation direction between the active position and the buffer position.

2. The sheet stack handler according to claim 1, wherein the sliding frame is a rigid frame that on it defines fixed, non-overlapping positions for the first and second, liftable stack supports.

3. The sheet stack handler according to claim 1, wherein the first and the second lifts are mounted onto the sliding frame besides one another in the translation direction.

4. A printer comprising sheet stack handler according to claim 1.

5. The sheet stack handler according to claim 1, wherein the first and second, liftable stack supports are each configured to support a pallet whereupon the stack of sheets is provided.

6. A sheet stack handler comprising a sheet stacker and/or a sheet feeder comprising:

a first and a second, liftable stack support, each configured to support a stack of sheets;

an individual sheet engager comprising a sheet-to-stack supplier for stacking a sheet onto a stack of sheets one of the first or second, liftable stack supports and/or a sheet-from-stack separator for separating a sheet from a stack of sheets on one of the first and second liftable stack supports;

a lift assembly for moving the first and/or second liftable stack support between a bottom position and a top position, which are respectively positioned spaced apart from and adjacent the individual sheet engager, such that a stack holding volume is defined between the bottom position and top position, and wherein the lift assembly is further configured to position a top sheet of the stack on the first and/or second, liftable stack support inside the stack holding volume at an operative level of the individual sheet engager, such that the individual sheet engager can stack a new sheet onto the top sheet and/or separate the top sheet from the respective stack, wherein the lift assembly comprises a first lift for lifting and/or lowering the first, liftable stack support and a second lift for lifting and/or lowering the second, liftable stack support independent of the first, liftable stack support;

a translation mechanism configured to translate at least one of the first and second, liftable stack supports while supporting a stack of sheets between a buffer position outside of and on one side of the stack holding volume and an active position inside the stack holding volume, wherein two buffer positions are provided on opposite sides of the stack holding volume, such that moving one of the of the first and second, liftable stack support from one of the buffer positions to the active position moves the other of the first and second, liftable stack supports from the active position to the other one of the buffer positions.

7. The sheet stack handler according to claim 6, further comprising a housing surrounding the stack holding volume, wherein the buffer positions extend outside said housing, so that in the buffer positions the first and second, liftable stack supports are accessible for loading and/or unloading a pallet therefrom.

8. A sheet stack handler comprising a sheet stacker and/or a sheet feeder comprising:

a first and a second, liftable stack support, each configured to support a stack of sheets;

an individual sheet engager comprising a sheet-to-stack supplier for stacking a sheet onto a stack of sheets one of the first or second, liftable stack supports and/or a sheet-from-stack separator for separating a sheet from a stack of sheets on one of the first and second liftable stack supports;

a lift assembly for moving the first and/or second liftable stack support between a bottom position and a top position, which are respectively positioned spaced apart from and adjacent the individual sheet engager, such that a stack holding volume is defined between the bottom position and top position, and wherein the lift assembly is further configured to position a top sheet of the stack on the first and/or second, liftable stack support inside the stack holding volume at an operative level of the individual sheet engager, such that the individual sheet engager can stack a new sheet onto the top sheet and/or separate the top sheet from the respective stack;

a translation mechanism configured to translate at least one of the first and second, liftable stack supports while supporting a stack of sheets between a buffer position outside of and on one side of the stack holding volume and an active position inside the stack holding volume; and a translation guide beam along which the second, liftable stack support is movable when moving in and out of the stack holding volume, wherein the translation guide beam extends parallel to a horizontal direction during use, wherein the lift assembly further comprises:

a first lift for moving the first, liftable stack support between the bottom position and the top position, and wherein the second, liftable stack support is movable in a direction independent of the first, liftable stack support perpendicular to lifting directions of both the first and second liftable stack supports between the buffer position and an active position wherein the second, liftable support is inside the stack holding volume and extends over the first, liftable stack support, such that the individual sheet engager is able to stack and/or separate sheets on and/or from a second stack of sheets on the second, liftable stack support; and a second lift for lowering and raising the second, liftable stack support independently of the first lift, wherein the second, liftable stack support is dimensioned and positioned be inserted into the stack holding volume without contacting the first lift at least between the top and bottom positions, wherein the second lift is positioned outside the stack holding volume when the second, liftable stack support has been inserted into the stack holding volume.

9. The sheet stack handler according to claim 8, wherein the second, liftable stack support does not overlap with lifting lines of the first lift, when viewed in the vertical direction.

10. The sheet stack handler according to claim 8, further comprising a controller configured to determine when a number of sheets in the stack on the first, liftable stack support matches or crosses a predetermined threshold, to then control the first, liftable stack support to be positioned at the bottom position, followed by controlling the second, liftable stack support to be inserted into the stack holding volume, and to transmit stack support information for prompting said information on a user interface.

* * * * *